US006676277B1

(12) United States Patent
Gordin

(10) Patent No.: US 6,676,277 B1
(45) **Date of Patent: *Jan. 13, 2004**

(54) APPARATUS AND METHOD FOR CONNECTING AND DISCONNECTING ELECTRICAL POWER TO AN HIGH INTENSITY ARC TUBE

(75) Inventor: Myron K. Gordin, Oskaloosa, IA (US)

(73) Assignee: Musco Corporation, Oskaloosa, IA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 9 days.

(21) Appl. No.: 09/076,278

(22) Filed: May 12, 1998

(51) Int. Cl.[7] ..... F21K 5/00
(52) U.S. Cl. ..... 362/263; 362/226; 313/51
(58) Field of Search ..... 362/263, 265, 362/257, 226; 313/51, 318.02; 439/588, 281, 611, 612; 445/22

(56) References Cited

U.S. PATENT DOCUMENTS 3,883,732 A * 5/1975 Peterson et al. ..... 362/264
3,940,606 A * 2/1976 Lemons ..... 362/263
4,090,759 A * 5/1978 Herrmann ..... 439/281
4,288,846 A * 9/1981 Fletcher et al. ..... 362/260
4,771,207 A * 9/1988 Page ..... 313/25
4,877,991 A * 10/1989 Colterjohn ..... 313/22
5,351,174 A * 9/1994 Ewing ..... 362/263
5,416,677 A * 5/1995 Stanuch ..... 362/263
5,707,142 A 1/1998 Gordin ..... 362/346
5,722,768 A * 3/1998 Suzuki et al. ..... 362/265

OTHER PUBLICATIONS

GE Ligthing Systems, Ultra☆Sport™Floodlight Product Guide; 12 Brochure, OLP–2518A; General Electric Company, Hendersonville, NC 28793; 5/96(5M)GELS.

* cited by examiner

*Primary Examiner*—Mark A. Robinson
(74) *Attorney, Agent, or Firm*—McKee, Voorhees & Sease, P.L.C.

(57) ABSTRACT

An apparatus and method for connecting and disconnecting electrical power to an arc tube includes a high intensity discharge arc tube having a body and electrodes extending from the exterior of the body into the interior of the arc tube body. Electrical leads are connected to the exterior ends of the electrodes and have an length that allows distal ends of the leads to be extended a distance away from the arc tube. Connectors at the distal ends of the leads are adapted to connect to electrical power leads. The connectors, the leads, and the connection of the leads to the electrodes of the arc tube all are electrically insulated from human touch. Therefore, electrical power through the arc tube can be connected and disconnected at a location away from the arc tube, without direct exposure of humans to electrically conducting surfaces for safety purposes.

13 Claims, 6 Drawing Sheets

APPARATUS AND METHOD FOR CONNECTING AND DISCONNECTING ELECTRICAL POWER TO AN HIGH INTENSITY ARC TUBE

BACKGROUND OF THE INVENTION

1. Field of the Invention

The present invention relates to light sources utilizing arc tubes, and in particular, to an apparatus and method for connecting and disconnecting electrical power to a high intensity arc tube.

2. Problems in the Art

Many high powered lights utilize arc tubes as the light source. Arc tubes can create intense light from a relatively small package. Also, arc tubes can generate such light in a relatively efficient and a economical manner.

Substantial amounts of electricity are required, however, to generate light from arc tubes on the scale necessary for wide area lighting, for example. A side-effect of generation of light in this manner is also the generation of substantial amounts of heat. Therefore, two matters that must be addressed, with high intensity arc tubes are the danger presented to humans because of the amount of electrical power presented to arc tubes, as well as the high levels of heat that present not only as a danger to humans, but is potentially detrimental to the longevity of the electrical connections of the arc tube to the source of electricity for the arc tube.

Most arc tubes have a finite life span. Therefore, there are times when the arc tubes must be replaced in a fixture. Other times repair or maintenance on the fixtures requires opening of the fixture for interior access. On the other hand, because arc tubes must be replaced, fixtures generally have quick attach/detach mounts for each end of the arc tube to make replacement of the arc tubes quicker and easier.

Conventionally, short electrical leads are connected to the electrodes at each of an arc tube and an electrical connector is placed at the distal ends of the short leads. The electrical connector is many times an exposed electrically conducting component that can be screwed or otherwise mounted to another electrically conducting terminal that is connected to wiring that would then go to the electrical power source. Such exposed electrical connections represent a real and significant safety risk to persons working with such fixtures. If care is not taken, human contact to such surfaces could result in electrical shock. Still further, most of those connections are, because of the short electrical leads and space constraints inside the fixture, close to the ends of the arc tube or arc lamp inside the fixture. Therefore, the electrical connections and the leads must be able to withstand such heat over many hours of operation of the arc tube. They must therefore be made of special heat-handling materials. Also, during, and for a time after operation of the arc tube, the heat is such that any human working near the arc tube would also have the real and substantial danger of burn if they touched the arc tube.

Because some fixtures utilizing arc tubes, for example for sports lighting, are elevated on poles well above the ground, and at a location remote from any main power disconnect for electrical power to the fixtures, there is a risk that the worker will incorrectly assume the electrical power to the fixture has been turned off. There is no easy way to check the same and therefore the worker may risk going forward with opening the fixture when the electrical power is on and thus expose himself/herself to danger.

Still further, if the arc lamp has malfunctioned or no longer works for some reason, the worker may be misled to think that the power is off to the fixture because the light is not on or does not turn on. Again, such a mistake could risk serious consequences.

Some fixture manufacturers address this problem by including in the fixture hardware which automatically is intended to disconnect electrical power to the arc tube if the access opening to the fixture is opened. Essentially, if the access door is open, this system automatically breaks the electrical circuit to the arc tube. It therefore intends, in all cases, to remove electrical shock risk when a worker is working inside the fixture.

However, this does not address the problem of burns from the hot arc tube or the problem with failure of electrical connections that are placed near the ends of the arc tube, because of the heat generated from the arc tube. Still further, this adds complexity and cost to lighting fixtures. For example, conventional systems for automatic disconnect of electrical power to the arc tube utilize a switch or contactor. These components can individually cost on the order of $30 to $40 each. Also, there is the possibility that such components may fail or malfunction. Furthermore, such systems do not eliminate the requirement there still must be a manual connect and disconnect of the wiring to the arc tube at a position at or near the ends of the arc tube to replace the arc tube.

It has therefore been identified that there is a need in the art for a better solution to a way in which electrical power is connected and disconnected to an arc tube for a lighting fixture. It is therefore a principal object of the present invention to provide an apparatus and method which improves over or solves the problems and deficiencies in the art. Other objects of the invention include an apparatus and method which:

1. Provide a positive, fail-safe method of connecting and disconnecting electrical power to an arc tube.
2. Eliminates costs and weight by eliminating a need for automatic disconnect components.
3. Eliminates connection and disconnection of electrical power to the electrodes of an arc tube at a position at or near the electrodes of the arc tube.
4. Allows placement of the connection of electrical power to the arc tube at a position away from the arc tube and the heat generated from the arc tube.
5. Fosters a more durable electrical connection to electrical power.
6. Allows more economical and less complex materials to be used for the connections.

These and other objects, features, and advantages of the present invention will become more apparent with reference to the accompanying specification and claims.

SUMMARY OF THE INVENTION

The present invention is an apparatus and method for connecting and disconnecting electrical power to an arc tube inside a lighting fixture. The method includes mounting into a fixture an arc tube and connecting electrical power to leads to the electrodes of the arc tube at a position substantially spaced from the arc tube in the fixture. The apparatus of the invention includes an arc tube having first and second electrodes. Electrically insulated leads are connected to the electrodes and extend to distal ends. Connectors on the distal ends are connectable to complimentary connections of electrical power leads. The connectors and the electrical leads from the arc tube, including connections of the leads at the arc tube electrodes, are all insulated or shielded from direct human exposure to the electricity. The connections to electrical power therefore are not only at a location farther away from the arc tube and more remote in the fixture from the heat generated by the arc tube during operation, but also have no exposed parts to reduce the risk of electrical shock to a person connecting or disconnecting the leads, even if electrical power is on.

DETAILED DESCRIPTION OF PREFERRED EMBODIMENTS

Figure 1:
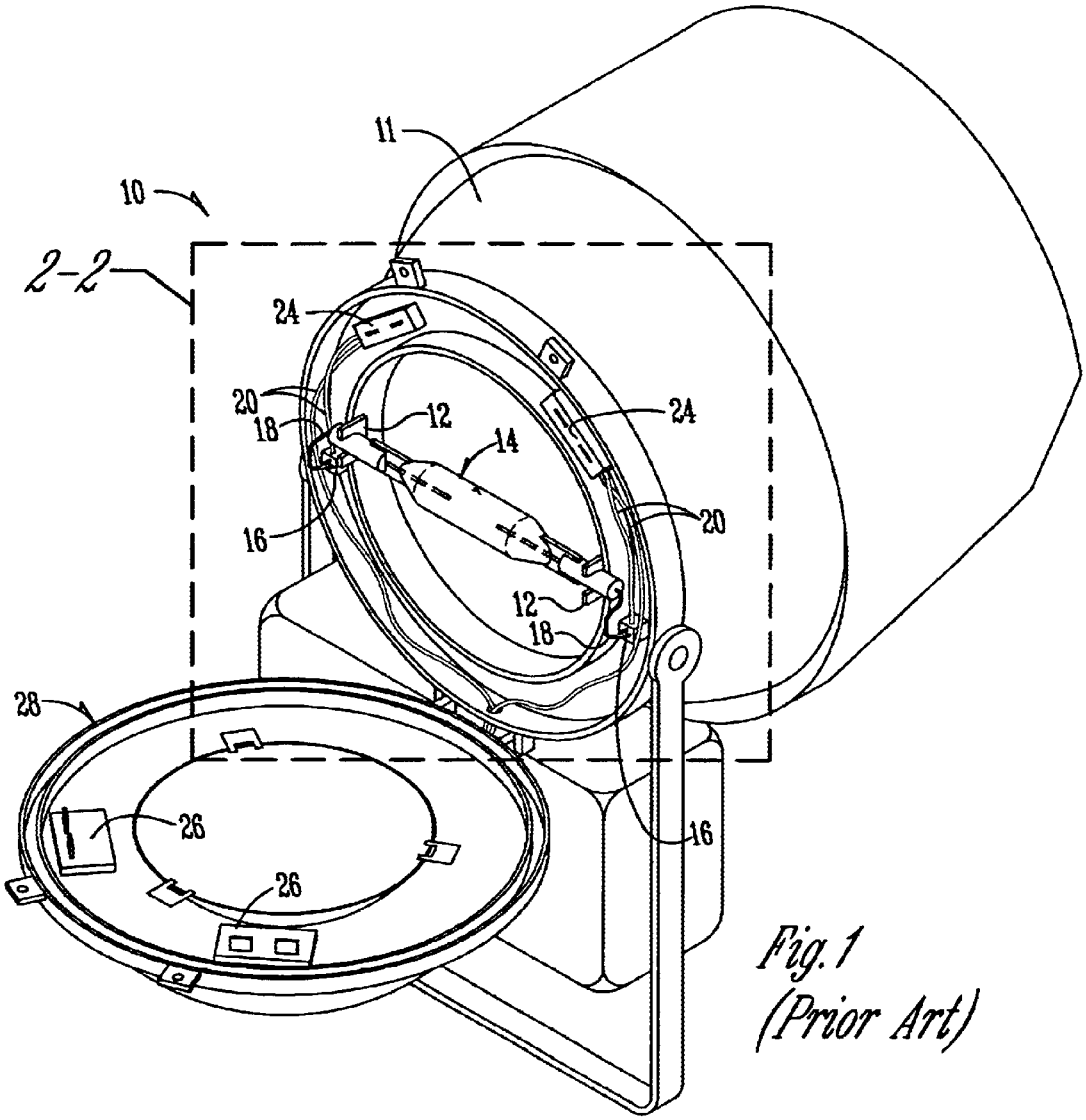
Fig. 1 (Prior Art)
FIG. 1 is a perspective view of a lighting fixture having a replaceable arc tube and its mounts inside the fixture, along with automatic power disconnect components.

For a better understanding of the invention, preferred embodiments will be described in detail herein. Frequent reference will be taken to the figures which have reference numerals which indicate certain parts and locations in the figures. The same reference numerals will be used to indicate the same parts and locations throughout the figures unless otherwise indicated.

The environment of the preferred embodiments now discussed relates to high intensity arc tubes utilized in lighting fixtures for wide area lighting such as sports field, race track, and arena lighting. To illustrate the preferred embodiment, a metal halide arc tube, such as are well know in the art, will be described in relationship to its use with two types of fixtures. It is to be understood, however, that similar principals can apply to other types of fixtures utilizing other types of arc tubes.

FIG. 1 illustrates a fixture 10. Fixture 10 includes a main housing 11 which encloses a reflecting surface (not shown), a front opening and lens (not shown), mounts 12 (shown in simplified fashion) to releasably hold opposite ends of an arc tube 14, and power connections 16 to attach arc tube leads 18 to electrical power leads 20, which are ultimately connected to a source of electrical power 22 (See FIG. 2). FIG. 1 also shows power circuit interrupter blocks 24 and power circuit completer blocks 26, which function in association with removable rear cover 28 and housing 11 to automatically disconnect power from power source 22 when cover 28 is removed from fixture 10 to expose arc tube 14 and the electrical leads 18, connectors 16, and power leads 20.

Blocks 24 can simply have two female receivers in electrical conducting communication with sections of power leads 20. The receivers define a gap or interruption in each power lead 20. Blocks 26 can simply comprise two male electrical conducting members that are in electrical conducting communication with each other. When the male ends of a block 26 are inserted into the female receivers in a block 24, there is no interruption in the corresponding electrical power lead 20. When the male ends are removed, no electrical power can travel through the gap and it effectively, automatically disconnects electrical power to arc tube 14, in this instance, if rear cover 28 is removed.

As described above, the automatic disconnect is intended to, in a fail-safe manner, cut off electrical power to arc tube 14 if cover 28 is removed to access the interior of fixture 10.

Figure 2:
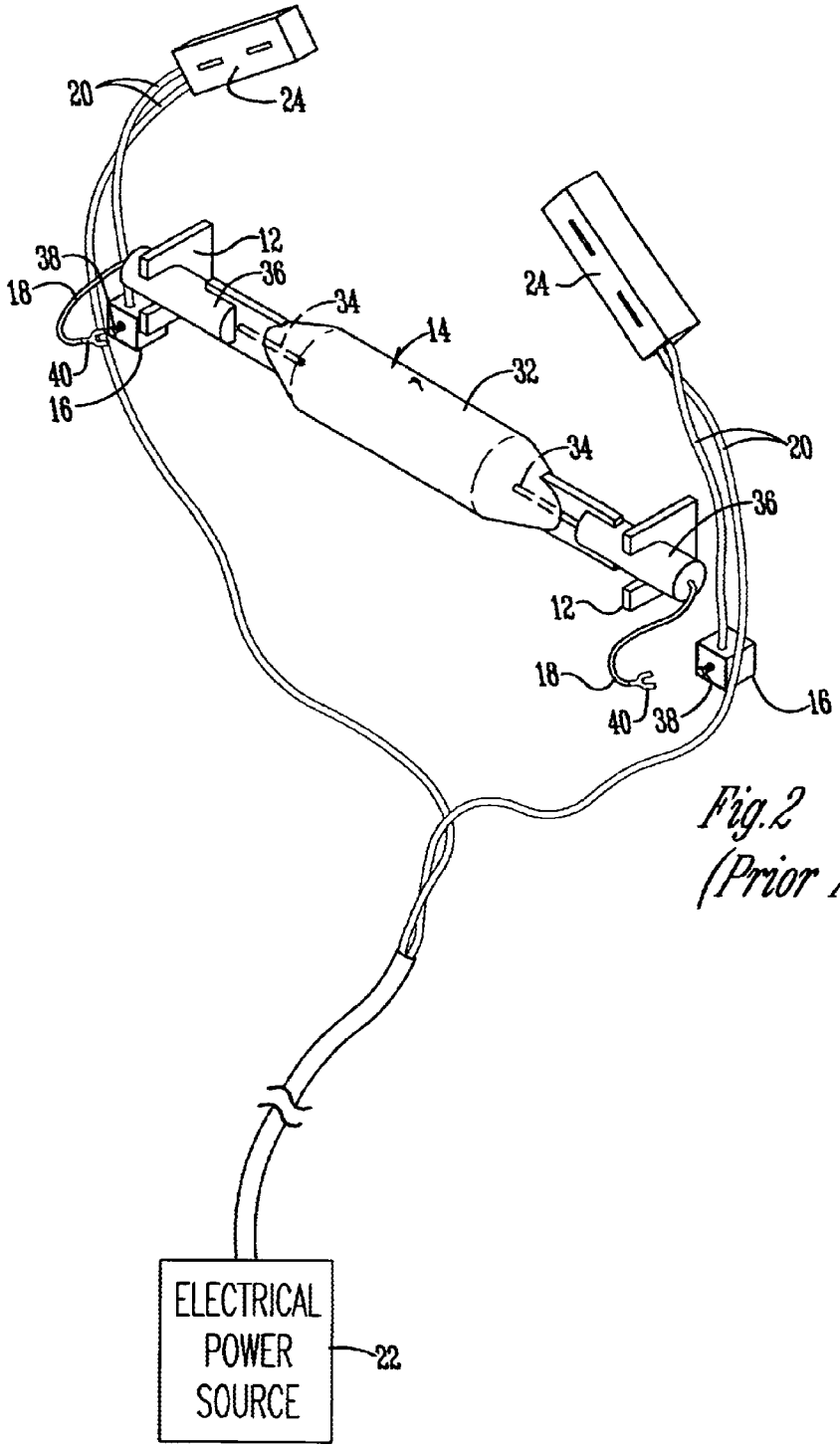
Fig.2 (Prior Art)
FIG. 2 is an isolated enlarged view of the arc tube, mount, and power connections of the fixture of FIG. 1, and schematically showing the automatic power disconnect components.

FIG. 2 shows in more detail the pertinent components of FIG. 1. It can be seen that arc tube 14 includes a quartz tubular body 32. Electrodes 34 have adjacent ends positioned inside envelope 32. Inner ends of electrodes 34 extend into arc tube 14. Outer ends of electrodes 34 are encased in ceramic insulators 36 which are fused or attached to arc tube body 32. Arc tube leads 18 extend from insulators 36 and are covered with high temperature insulation (such as Teflon). Connection posts 38 can consist, for example, of a metal screw in a metal base plate. The distal ends of leads 18 can comprise C-shaped exposed metal connectors 40 that can be inserted around screws 38. Similarly, power leads 20 can include connections that can be secured around screws 38 or alternatively can be electrically connected to screws 38 inside connector 16. Screws 38 are then turned down into their base plates to secure electrical connection between leads 18 and 20. Screws 38 are turned up to release the C-shaped connectors of at least leads 18, if arc tube 14 is to be removed from mounts 12 for replacement, repair or maintenance.

As can be appreciated, however, by FIGS. 1 and 2, the disconnection of arc tube 14 from mounts 12 requires a worker to physically engage screws 38. Moreover, screws 38 are at a position that are relatively close to arc tube 14. Therefore, if arc tube 14 had been recently operating and the worker has to replace it, the worker would be in very near proximity to the arc tube, which can be very hot during operation and for a time thereafter.

Still further, the heat generated by operation of arc tube 14 for a long period of time can affect the durability of the connections between leads 18 and connectors 38, or that of power leads 20 and connectors 38.

Figure 3:
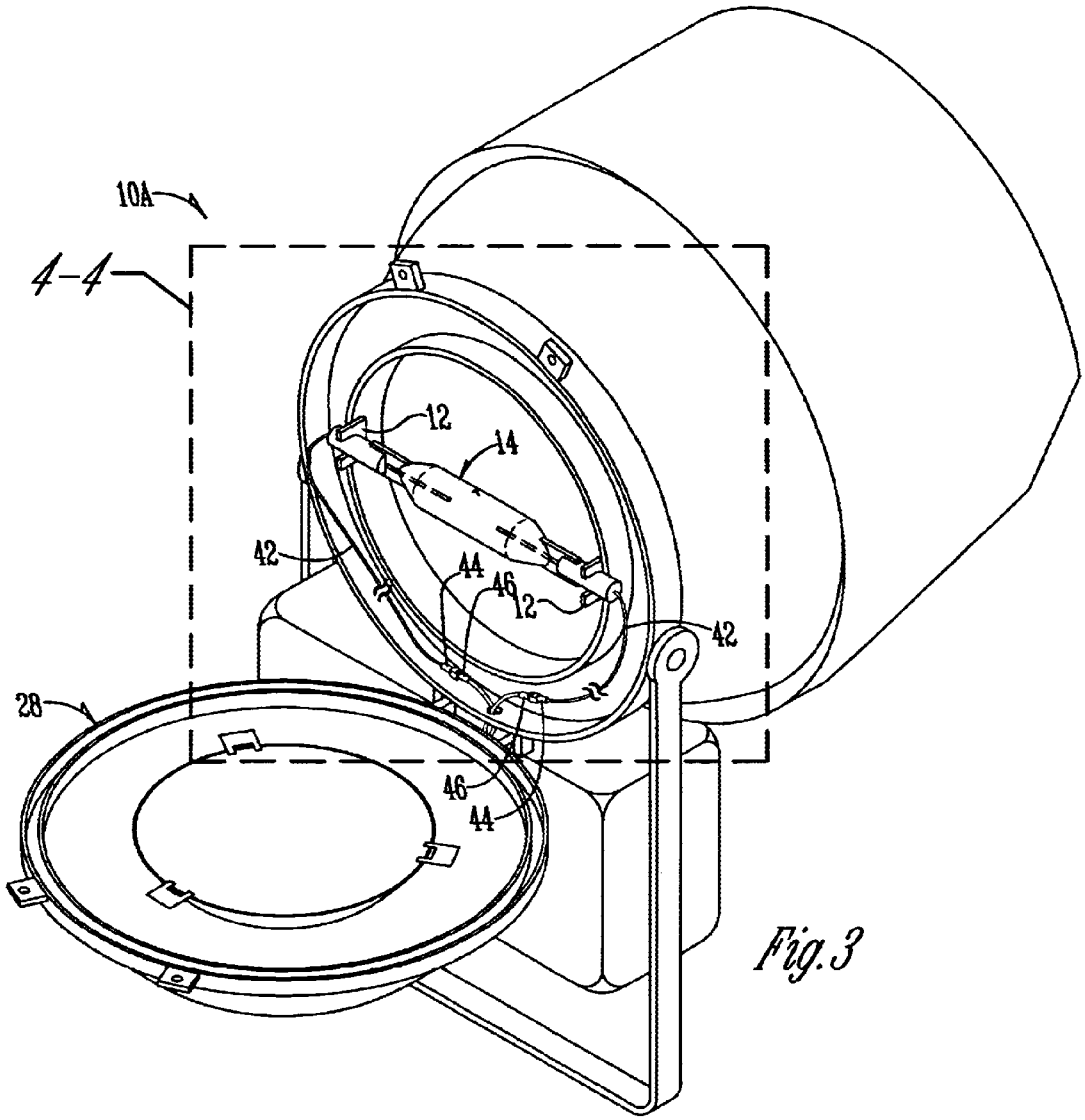
FIG. 3 is similar to FIG. 1 but shows a preferred embodiment of the present invention substituted for the electrical power connections. and automatic disconnect components of the fixture FIG. 1.
Figure 4:
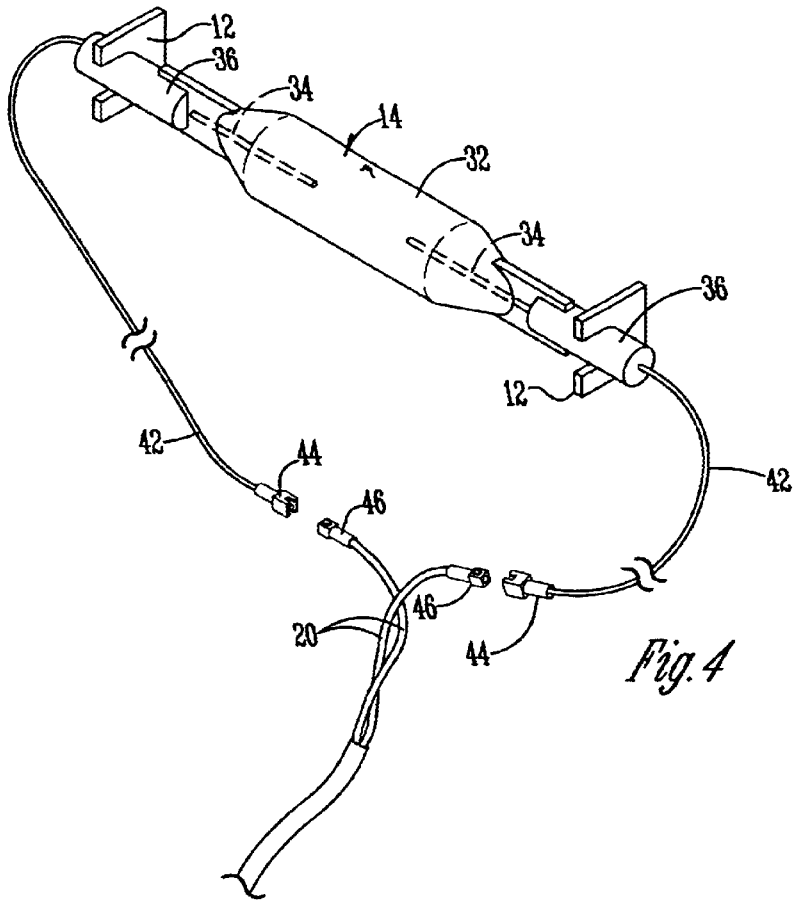
FIG. 4 is similar to FIG. 2 and shows the preferred embodiment of the present invention in enlarged fashion.

FIG. 3 shows fixture 10A with a power connect/disconnect system according to the present invention. Arc tube 14 and its mounts 12 remain the same. However, the differences are as follows. As can be seen in FIG. 4, arc tube leads 42, being of substantial length compared to leads 18 of FIGS. 1 and 2, are substituted for the short levels 18. A substantial length can be on the order of around five inches or more. Leads 42 are connected to insulators 36 at ends of arc tube 14 and covered with an insulator. At the distal ends of leads 42 are connectors 44, which in the preferred embodiment, are quick-connect electrical connectors that can connect to complimentary connectors 46 at the ends of power leads 20.

Leads 42 in FIG. 4, can be of a length that allows their distal ends to be positioned sufficiently away from arc tube 14 to reduce risk of touching arc tube 14 when disconnecting electrical power and which allows use of plastic mateable connectors (as opposed to high temperature materials like ceramics) and also reduces risk of damage to the connections because of heat from the arc tube. An example is several feet long. Connectors 44 are pin and socket connectors available at electrical equipment supply retailers and wholesalers. One example is a Universal MATE-N-LOCK (1 circuit, free hanging) connector made by AMP company of, Harrisburg, Pa. telephone number 1-800-522-6752).

Figure 5:
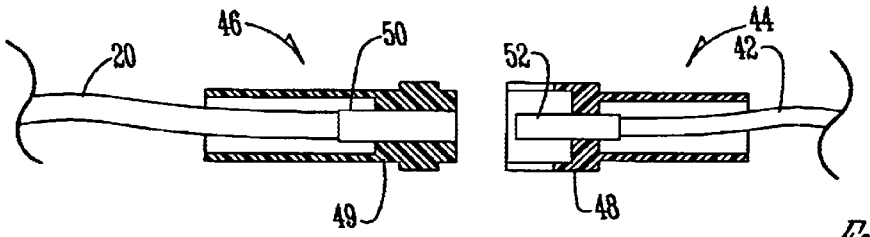
FIG. 5 is an enlarged cross-sectional view of mating electrical power connectors in disconnected position used with the embodiment of FIG. 4.
Figure 5A:
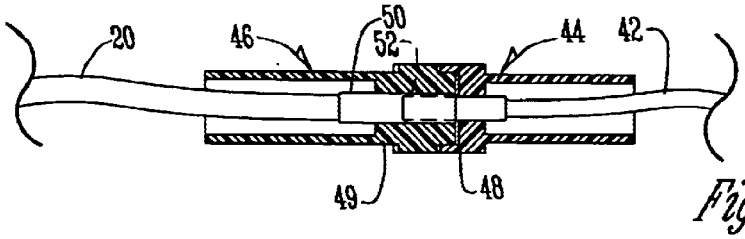
FIG. 5A is similar to FIG. 5, but shows the mating power connectors in connected position.

A primary characteristic of connectors 44, and their complimentary connectors 46, is that no electrically conducting component of such connectors is readily exposed to contact by humans. As shown in FIG. 5, both connectors 44 and 46 have outer shells 48 and 49 respectively that are made of electrically insulating material such as plastic. Inside of complimentary shells 48 and 49 are female 50 and male 52 members, respectively (See FIG. 5), components which mate together when shells 48 and 49 are brought together in a nesting relationship (See FIG. 5A). Female and male members 50 and 52 are caused to be in alignment when shells 48 and 49 are brought together and create an electrical connection inside of shells 48 and 49. There is no surface that is directly exposable to human touch. Connectors 44 and 46 also have releasable inter-locking structure which holds them together when mated, but which allows quick release.

It therefore can be seen in FIGS. 3–5 when door or cover 28 is removed from the back of fixture 10A, connectors 44 and 46 are positioned away from arc tube 14. Therefore, even if arc tube 14 had just been operating, the worker can safely grasp connectors 44 and 46, and because of the length of leads 42, pull that connection outside of the interior of lamp 10A and safely pull them apart to disconnect the electrical power. Electrical power can be alternating current, and is usually of high voltage. Moreover, when reaching in to grab connectors 44 and 46, there is not any exposed electrical surface, such as exists with posts 38 in FIGS. 1 and 2, to prevent a source of electrical shock. The worker does not have to reach in anywhere near arc tube 14, thus reducing the risk of a burn.

Once connectors 44 and 46 are separated, the worker has positive and visually verifiable proof that electrical power is disconnected to arc tube 14. Also, during operation of fixture 10A, connectors 44 and 46 are at a position remote from arc tube 14 inside fixture 10A. Therefore, the electrical connection is less likely to be affected by the heat generated by arc tube 14 over time. It has been found that the closer one makes the electrical connection to arc tube 14, the more the risk of the connection going bad over time.

Therefore, for safety reasons, both electrical and heat, and for durability issues, the embodiment of FIGS. 3–5 addresses each. It also can allow the complete elimination of the power disconnect circuitry (e.g. blocks 24 and 26 and associated mounts and wiring) shown in FIGS. 1 and 2 which can represent a substantial cost savings in light of the fact such components can cost several tens of dollars. Those components also increase the complexity of the fixture and cause maintenance personnel to rely on the circuitry rather on any objectively verifiable power disconnect, such as is available with connectors 44 and 46 and leads 42. Other fixtures utilize electrical components such as contractors and/or switches as an automatic disconnect. These can be eliminated by the invention. Some fixtures cut off power to ballasts instead of directly to the arc tube. Likewise, the invention eliminates the components needed to do this.

Figure 6:
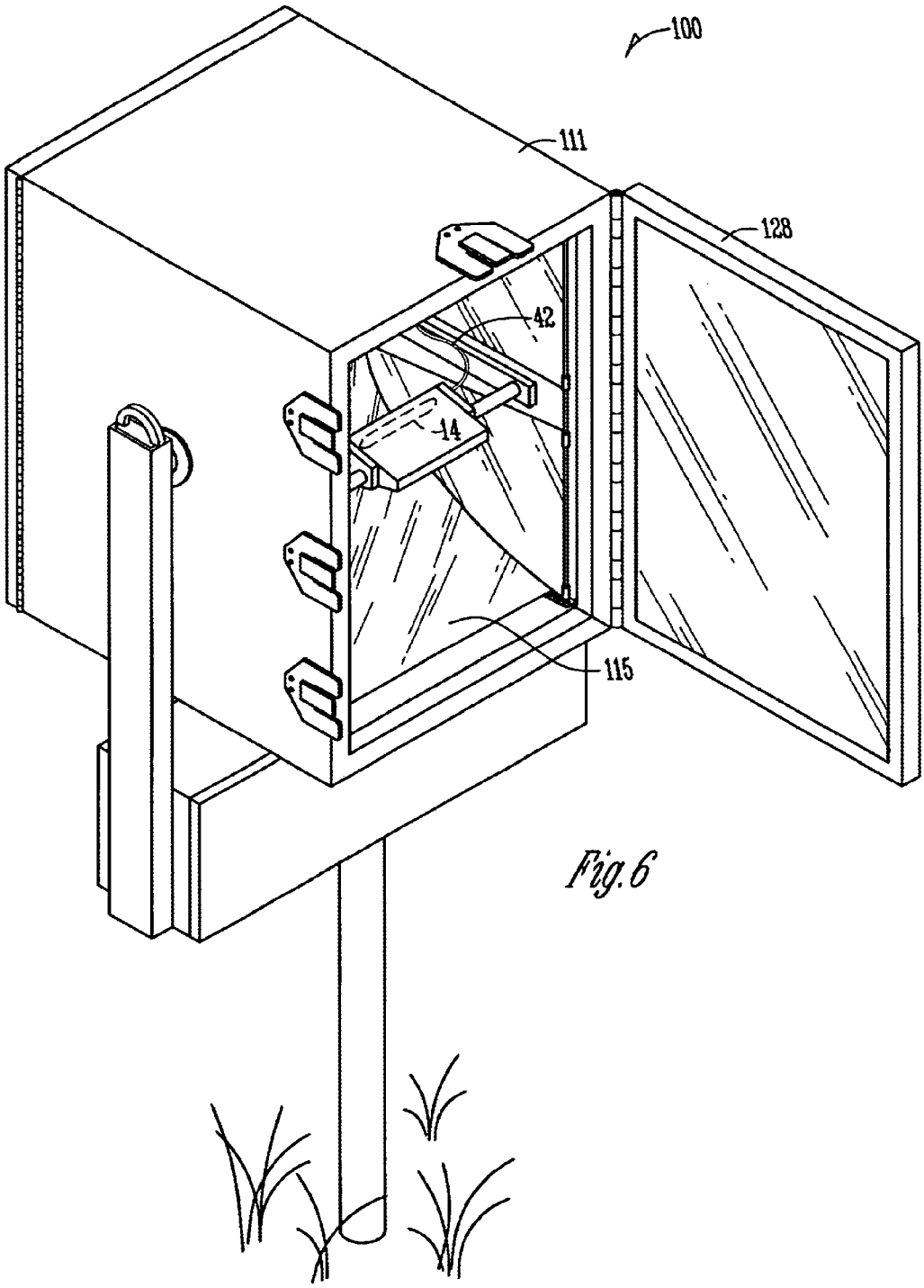
FIG. 6 is a front prospective view of another fixture type with which the invention can be used.
Figure 7:
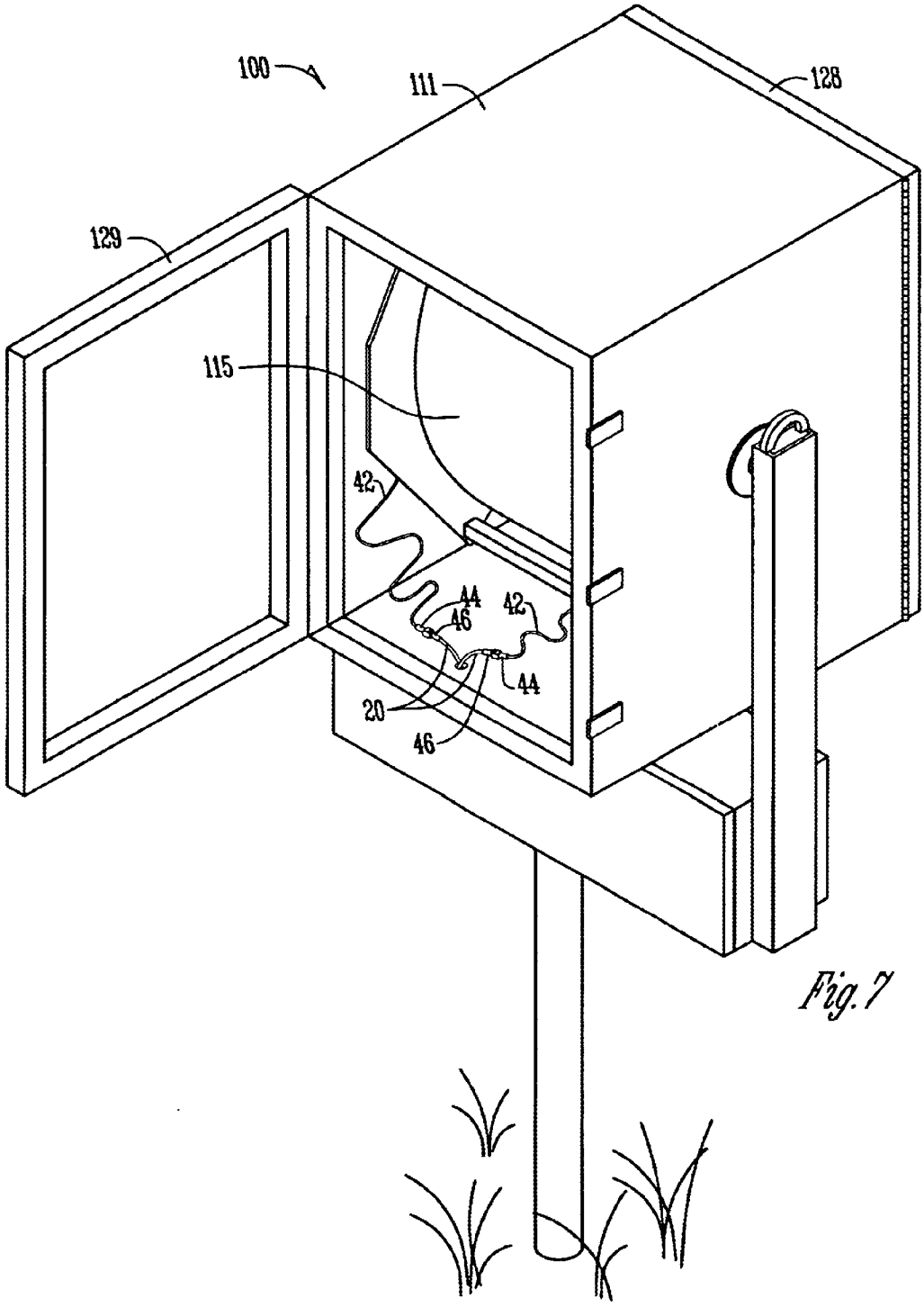
FIG. 7 is a rear perspective view of the fixture of FIG. 6 showing a preferred embodiment of the invention.

FIGS. 6 and 7 show another preferred embodiment of the invention, illustrating its wide application to fixtures with arc tubes. The fixture 100 of FIG. 6 comprises a housing 111 with a hinged front door 128 to access the interior of fixture 100. For additional details about fixture 100, one can refer to commonly owned U.S. Pat. No. 5,647,661 issued Jul. 15, 1997, incorporated by reference herein. An arc tube 14 is held suspended by appropriate structure. Arc tube leads 42 extend from opposite ends of arc tube 14.

FIG. 7 shows housing 128 has a rear hinged door 129 to gain access to the rear of fixture 100. Leads 42 extend rearwardly from arc tube 14 (See FIG. 6) back behind the reflector 115 to the rear bottom of fixture 100. Leads 42 are each approximately 36" long. Fixture 100 is roughly 2' wide, by 2' deep, by 2' tall. Therefore, connections 44/46 are a substantial distance away from arc tube 14 in a much cooler position inside fixture, yet are easy to grasp and operate (connect or disconnect).

Different connectors could be used. Preferably, all electrically conducting surfaces would be shielded or blocked from direct human contact.

If connectors 44/46 are nearer to arc tube 14, connectors 44/46 could be made of more heat-resistant materials like ceramic or Teflon or could be Teflon coated. Connections of the type needed can be made by those of one skilled in the art. Different approaches can be made to prevent direct exposure of electrically conducting surfaces while both connections 44/46 are so protected.

The cooler the position of connectors 44/46, the better. Although longer leads are contra-indicated, use of longer leads provides the advantages according to the invention to diminish the thermal problems discussed herein.

The included preferred embodiment is by way of example only and not by way of limitation, which is solely defined by the claims herein. Variations obvious to those skilled in art will be included within the invention.

What is claimed is:

1. A method of electrically connecting a double-ended unjacketed high intensity discharge arc lamp tube with sealed opposite ends and on the order of 400 watts or greater adapted for use in a wide area lighting fixture, to a high voltage electrical power source comprising:

attaching insulated leads to each sealed end of the arc tube, the leads having a length greater than the length of the arc tube;

terminating the opposite ends of the leads with a first connector having no directly exposed electrically conducting surface capable of direct contact by human fingers or other body parts whether connected or disconnected;

mounting the arc tube in a tube mount in a lighting fixture;

plugging the first connectors into mating second connectors having no directly exposed electrically conducting surface capable of direct contact by human fingers or other body parts whether connected or disconnected, the mating second connector being adapted for electrical connection to an electrical power source, the connection between said first connectors and said mating second connectors being at a location away from the arc tube.

2. The method of claim 1 wherein the length is on the order of 5 inches or more.

3. The method of claim 1 wherein the step of terminating comprises utilizing pin and socket connectors.

4. The method of claim 1 wherein no direct exposure to electrical energy exists between the arc tube and the electrical power source.

5. The method of claim 1 wherein the electrical power source is an alternating current power source.

6. The method of claim 5 wherein the alternating current power source is high voltage.

7. The method of claim 1 further comprising the lighting fixture includes a door that is openable to the interior of the fixture in which the arc tube is mounted.

8. A high intensity light fixture including a housing, a mount in the housing to removably mount a double-ended unjacketed high intensity discharge lamp with sealed opposite ends and on the order of 400 watts or greater adapted for use in a wide area lighting fixture, an openable access section to the interior of the housing and to the mount, and leads from an electrical power source, the improvement comprising:

electrically insulated, covered leads having a length and first and second ends, the first ends connected to opposite electrodes of the arc tube, the length being such that second ends of the leads can be extended away from the ends of the arc tube to areas within the housing away from the lamp;

connectors on such second ends, the connectors having a body and an electrically conducting member inside the body;

the body substantially covering and enclosing the member and being electrically insulated but allowing a complementary connector to enter into electrical conducting relationship with the member with no directly exposed electrically conducting surface capable of direct contact by human fingers whether connected or unconnected.

9. A high intensity light source comprising;

a double-ended unjacketed high intensity discharge arc tube with sealed opposite ends and on the order of 400 watts or greater comprising a sealed substantially transparent chamber adapted for use in a wide area lighting fixture, first and second electrodes, each having one end extending into the chamber and the other end extending outside the chamber;

an electrically conducting lead having a proximal end in electrical communication with said other end of one of said first and second electrodes and having a distal end connected to an electrical connector member, the connector member having no directly exposed electrically conducting surfaces capable of direct contact by human fingers;

the lead having a length which is greater than the length of the arc tube allowing the connector member to be connected to a source of electrical power at a location away from the arc tube;

all parts of the arc tube, lead, and member having covering material, which prevents direct contact with any electrical conducting material whether connected or disconnected.

10. An apparatus for wide area lighting comprising:

a plurality of lighting fixtures;

one or more structures for elevating the lighting fixtures;

each fixture having an enclosed housing and mount to connect the fixture to said structure;

each housing having a body with a lens over an opening, a reflecting surface, and a high intensity light source enclosed in the housing;

the light source comprising a double-ended unjacketed high intensity discharge arc tube adapted for use in a wide area lighting fixture and on the order of 400 watts or greater having a tubular body with sealed opposite ends and electrodes extending from outside the body into the body;

electrical power supply leads having one end extending into the fixture and the other end adapted to connect to a source of electrical power;

connecting leads having first ends connected to the electrodes of the arc tube and distal ends, the leads having a length allowing the distal ends to be positioned away from the arc tube in the housing;

complementary electrical connections on said one ends of the electrical power leads and on the distal ends of the connecting leads;

all electrically conducting parts of the arc tube, electrodes, connecting leads, power leads, and any connections and connectors being insulated from human contact when the connections and connectors are engaged together or taken apart by human fingers and hands.

11. A double-ended unjacketed high intensity discharge lamp on the order of 400 watts or greater adapted for use in a wide area lighting fixture comprising:

an arc tube body with opposite ends;

an electrode in each opposite end;

an electrically insulated lead having a first end connected to an electrode, a second end, and a length allowing the second end to be located away from the first end and the arc tube;

an electrical power connection having a first end adapted for connection to an electrical power source and a second end;

the second end of each of the electrically insulated lead and the electrical power connection including either a manually releasable and engagable male or female conducting terminal including insulation material shielding each conducting terminal from direct contact with fingers or other parts of a human whether connected or disconnected.

12. The lamp of claim 11 wherein the lamp is a double-ended lamp with first and second electrodes, each having a lead and conducting terminals.

13. A high intensity discharge lamp adapted for use in a wide area lighting fixture comprising:

a double-ended unjacketed high intensity arc lamp on the order of 400 watts or greater including an electrode at each sealed end of the lamp;

a lamp lead having a first end connected to an electrode and having a length allowing second end to be located away from the lamp, the lamp lead being electrically insulated along its entire length;

a power lead having a first end adapted for connection to an electrical power source and a second end;

the second ends of the lamp lead and the power lead including one or the other of manually releasable and engagable male and female conducting terminals including insulation material shielding each from direct contact with finger or other parts of a human.

* * * * *